US008689641B2

(12) United States Patent
Janke et al.

(10) Patent No.: US 8,689,641 B2
(45) Date of Patent: Apr. 8, 2014

(54) DETECTING SATELLIZATION OF A LAUNDRY LOAD

(75) Inventors: Brian P. Janke, Saint Joseph, MI (US); Stephen L. Keres, Watervliet, MI (US); Peter J. Richmond, Berrien Springs, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/550,989

(22) Filed: Jul. 17, 2012

(65) Prior Publication Data

US 2014/0020482 A1 Jan. 23, 2014

(51) Int. Cl.
*G01L 3/02* (2006.01)

(52) U.S. Cl.
USPC ..... 73/862.192; 73/862.191; 73/862.193

(58) Field of Classification Search
USPC ..... 73/862.191, 862.192, 862.193
See application file for complete search history.

(56) References Cited

U.S. PATENT DOCUMENTS

| | | | | |
|---|---|---|---|---|
| 4,553,413 | A | 11/1985 | Genji et al. | |
| 6,564,592 | B2 | 5/2003 | Bruce et al. | |
| 6,578,225 | B2 | 6/2003 | Jonsson | |
| 7,739,764 | B2 | 6/2010 | Zhang et al. | |
| 2007/0044247 | A1 | 3/2007 | Park et al. | |
| 2007/0101511 | A1 | 5/2007 | Park et al. | |
| 2009/0151085 | A1* | 6/2009 | Altinier et al. | 8/159 |
| 2010/0000022 | A1 | 1/2010 | Hendrickson et al. | |
| 2010/0000024 | A1 | 1/2010 | Hendrickson et al. | |
| 2010/0000264 | A1 | 1/2010 | Luckman et al. | |
| 2010/0000573 | A1 | 1/2010 | Hendrickson et al. | |
| 2010/0000581 | A1 | 1/2010 | Doyle et al. | |
| 2010/0000586 | A1 | 1/2010 | Hendrickson | |
| 2010/0263136 | A1* | 10/2010 | Ashrafzadeh et al. | 8/159 |
| 2011/0005339 | A1* | 1/2011 | Ashrafzadeh et al. | 73/862.192 |
| 2011/0030150 | A1 | 2/2011 | Ashrafzadeh et al. | |
| 2011/0067186 | A1 | 3/2011 | Johansson | |
| 2011/0119839 | A1* | 5/2011 | Lilie | 8/159 |
| 2012/0118022 | A1* | 5/2012 | Ashrafzadeh et al. | 68/12.04 |

FOREIGN PATENT DOCUMENTS

| | | | |
|---|---|---|---|
| EP | 2379786 | B1 | 11/2012 |
| GB | 2361715 | B | 10/2003 |
| WO | 2010072556 | A1 | 7/2010 |

* cited by examiner

*Primary Examiner* — Lisa Caputo
*Assistant Examiner* — Jamel Williams

(57) ABSTRACT

A method of determining satellization of a laundry load in a washing machine by filtering a drum motor torque signal to block drum frequencies and pass high frequencies to enable further conditioning of the high frequencies and facilitate efficient and accurate determination of satellization.

13 Claims, 11 Drawing Sheets

DETECTING SATELLIZATION OF A LAUNDRY LOAD

BACKGROUND OF THE INVENTION

Laundry treating appliances, such as clothes washers, may include a perforate rotatable drum or basket positioned within an imperforate tub. The drum may at least partially define a treating chamber in which a laundry load may be received for treatment according to a selected cycle of operation. During at least one phase of a selected cycle, the drum and laundry load may be spun about a rotational axis at a predetermined high speed, sufficient to centrifugally move and hold laundry load items against the perimeter of the treating chamber, causing liquid to be removed from the laundry load. This speed may be referred to as the "satellization" speed.

Known methodologies may provide an estimate of satellization speed based upon a determination of laundry load inertia or mass, or the employment of an iterative process of drum rotation. However, these methods may be inefficient, or may provide results that may be inaccurate. It would be advantageous to efficiently determine the satellization speed accurately for a selected laundry load.

BRIEF SUMMARY OF THE INVENTION

An apparatus and method for determining the drum rotational speed at which laundry items become satellized by selectively filtering the motor torque signal.

DESCRIPTION OF AN EMBODIMENT OF THE INVENTION

Figure 1:
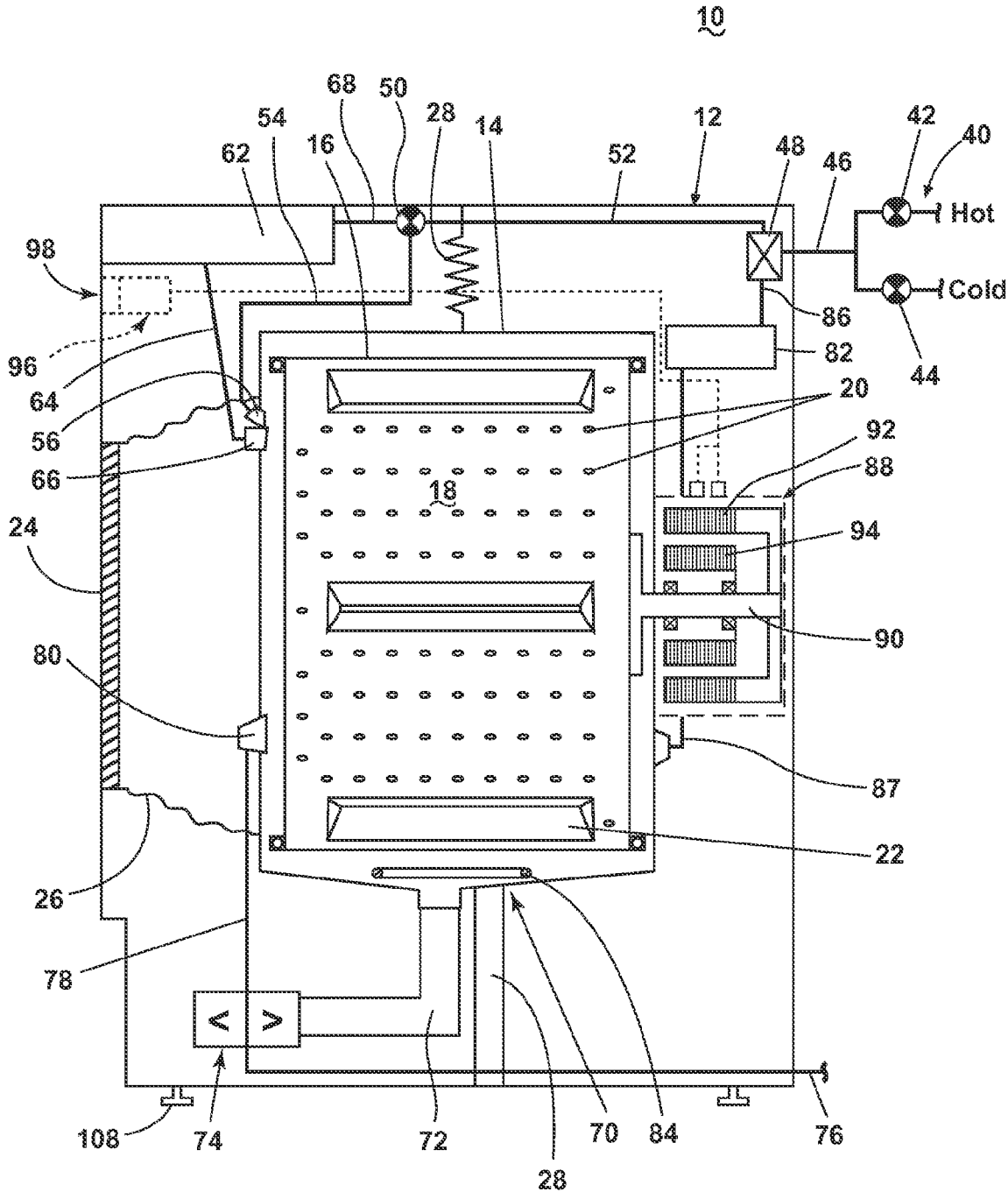
FIG. 1 is a schematic view of a laundry treating appliance in the form of a washing machine according to a first embodiment of the invention.

Referring now to the drawings, FIG. 1 is a schematic view of a laundry treating appliance according to an embodiment of the invention. The laundry treating appliance may be any appliance that performs a cycle of operation to clean or otherwise treat items placed therein, non-limiting examples of which include a horizontal or vertical axis clothes washer; a combination washing machine and dryer; a dispensing dryer; a tumbling or stationary refreshing/revitalizing machine; an extractor; a non-aqueous washing apparatus; and a revitalizing machine.

The laundry treating appliance of FIG. 1 is illustrated as a washing machine 10, which may include a structural support system comprising a cabinet 12 that defines a housing within which a laundry holding system resides. The cabinet 12 may be a housing having a chassis and/or a frame, defining an interior that encloses components typically found in a known washing machine, such as motors, pumps, fluid lines, controls, sensors, transducers, and the like. Such components will not be described further herein except as necessary for a complete understanding of the invention.

The laundry holding system may comprise a tub 14 supported within the cabinet 12 by a suitable suspension system 28 for dynamically suspending the laundry holding system within the structural support system, and a rotatable drum 16 provided within the tub 14 and defining at least a portion of a laundry treating chamber 18. The drum 16 may include a plurality of perforations 20 such that liquid may flow between the tub 14 and the drum 16 through the perforations 20. A plurality of baffles 22 may be disposed on an inner surface of the drum 16 to facilitate lifting of laundry items in the treating chamber 18 as the drum 16 rotates. It is also within the scope of the invention for the laundry holding system to comprise only a tub, with the tub defining the laundry treating chamber.

The laundry holding system may further include a door 24 that may be movably mounted to the cabinet 12 to selectively close both the tub 14 and the drum 16. A bellows 26 may couple an open face of the tub 14 with the cabinet 12, with the door 24 sealing against the bellows 26 when the door 24 closes the tub 14.

The washing machine 10 may further include a liquid supply system for supplying water to the washing machine 10 for use in treating laundry during a cycle of operation. The liquid supply system may include a source of water, such as a household water supply 40, which may include separate valves 42 and 44 for controlling the flow of hot and cold water, respectively. Water may be supplied through an inlet conduit 46 directly to the tub 14 by controlling first and second diverter mechanisms 48 and 50, respectively.

The diverter mechanisms 48, 50 may be a diverter valve having two outlets such that the diverter mechanisms 48, 50 may selectively direct a flow of liquid to one or both of two flow paths. Water from the household water supply 40 may flow through the inlet conduit 46 to the first diverter mechanism 48 that may direct the flow of liquid to a supply conduit 52. The second diverter mechanism 50 on the supply conduit 52 may direct the flow of liquid to a tub outlet conduit 54 that may be provided with a spray nozzle 56 configured to spray the flow of liquid into the tub 14. In this manner, water from the household water supply 40 may be supplied directly to the tub 14.

The washing machine 10 may also be provided with a dispensing system for dispensing treating chemistry to the treating chamber 18 for use in treating the laundry according to a cycle of operation. The dispensing system may include a dispenser 62 that may be a single use dispenser, a bulk dispenser or a combination of a single and bulk dispenser. Non-limiting examples of suitable dispensers are disclosed in U.S. Pub. No. 2010/0000022 to Hendrickson et al., filed Jul. 1, 2008, entitled "Household Cleaning Appliance with a Dispensing System Operable Between a Single Use Dispensing System and a Bulk Dispensing System," U.S. Pub. No. 2010/0000024 to Hendrickson et al., filed Jul. 1, 2008, entitled "Apparatus and Method for Controlling Laundering Cycle by Sensing Wash Aid Concentration," U.S. Pub. No. 2010/0000573 to Hendrickson et al., filed Jul. 1, 2008, entitled "Apparatus and Method for Controlling Concentration of Wash Aid in Wash Liquid," U.S. Pub. No. 2010/0000581 to Doyle et al., filed Jul. 1, 2008, entitled "Water Flow Paths in a Household Cleaning Appliance with Single Use and Bulk Dispensing," U.S. Pub. No. 2010/0000264 to Luckman et al., filed Jul. 1, 2008, entitled "Method for Converting a Household Cleaning Appliance with a Non-Bulk Dispensing System to a Household Cleaning Appliance with a Bulk Dispensing System," U.S. Pub. No. 2010/0000586 to Hendrickson, filed Jun. 23, 2009, entitled "Household Cleaning Appliance with a Single Water Flow Path for Both Non-Bulk and Bulk Dispensing," and application Ser. No. 13/093,132, filed Apr. 25, 2011, entitled "Method and Apparatus for Dispensing Treating Chemistry in a Laundry Treating Appliance," which are herein incorporated by reference in full.

Regardless of the type of dispenser used, the dispenser 62 may be configured to dispense a treating chemistry directly to the tub 14 or mixed with water from the liquid supply system through a dispensing outlet conduit 64. The dispensing outlet conduit 64 may include a dispensing nozzle 66 configured to dispense the treating chemistry into the tub 14 in a selected pattern and under a selected pressure. For example, the dispensing nozzle 66 may be configured to dispense a flow or stream of treating chemistry into the tub 14 by gravity, i.e. a non-pressurized stream. Water may be supplied to the dispenser 62 from the supply conduit 52 by directing the diverter mechanism 50 to direct the flow of water to a dispensing supply conduit 68.

Non-limiting examples of treating chemistries that may be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 may also include a recirculation and drain system for recirculating liquid within the laundry holding system and draining liquid from the washing machine 10. Liquid supplied to the tub 14 through tub outlet conduit 54 and/or the dispensing supply conduit 68 may enter a space between the tub 14 and the drum 16 and may flow by gravity to a sump 70 formed in part by a lower portion of the tub 14. The sump 70 may also be formed by a sump conduit 72 that may fluidly couple the lower portion of the tub 14 to a pump 74. The pump 74 may direct liquid to a drain conduit 76, which may drain the liquid from the washing machine 10, or to a recirculation conduit 78, which may terminate at a recirculation inlet 80. The recirculation inlet 80 may direct the liquid from the recirculation conduit 78 into the drum 16. The recirculation inlet 80 may introduce the liquid into the drum 16 in any suitable manner, such as by spraying, dripping, or providing a steady flow of liquid. In this manner, liquid provided to the tub 14, with or without treating chemistry, may be recirculated into the treating chamber 18 for treating the laundry within.

The liquid supply and/or recirculation and drain system may be provided with a heating system that may include one or more devices for heating laundry and/or liquid supplied to the tub 14, such as a steam generator 82 and/or a sump heater 84. The steam generator 82 may be any suitable steam generator, such as a flow-through steam generator or a tank-type steam generator. Liquid from the household water supply 40 may be provided to the steam generator 82 through the inlet conduit 46 by controlling the first diverter mechanism 48 to direct the flow of liquid to a steam supply conduit 86. Steam generated by the steam generator 82 may be supplied to the tub 14 through a steam outlet conduit 87. Alternatively, the sump heater 84 may be used to generate steam in place of or in addition to the steam generator 82. In addition to or instead of generating steam, the steam generator 82 and/or sump heater 84 may be used to heat the laundry and/or liquid within the tub 14 as part of a cycle of operation.

The liquid supply and recirculation and drain system may differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 may also include a drive system for rotating the drum 16 within the tub 14. The drive system may include a motor 88, which may be directly coupled with the drum 16 through a drive shaft 90 to rotate the drum 16 about a rotational axis during a cycle of operation. The motor 88 may be a brushless permanent magnet (BPM) motor having a stator 92 and a rotor 94. Alternately, the motor 88 may be coupled to the drum 16 through a belt and a drive shaft to rotate the drum 16, as is known in the art. Other motors, such as an induction motor or a permanent split capacitor (PSC) motor, may also be used. The motor 88 may rotate the drum 16 at selected speeds in either rotational direction.

The washing machine 10 may also include a control system for controlling the operation of the washing machine 10 to implement one or more cycles of operation. The control system may include a controller 96 located within the cabinet 12 and a user interface 98 that may be operably coupled with the controller 96. The user interface 98 may include one or more knobs, dials, switches, displays, touch screens and the like for communicating with a user, such as receiving input and providing output. The user may enter different types of information including, without limitation, cycle selection and cycle parameters, such as cycle options.

The controller 96 may include a machine controller and any additional controllers for controlling any of the components of the washing machine 10. For example, the controller 96 may include the machine controller and a motor controller. Many known types of controllers may be used for the controller 96. The specific type of controller is not germane to the invention. It is contemplated that the controller may be a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

Figure 2:
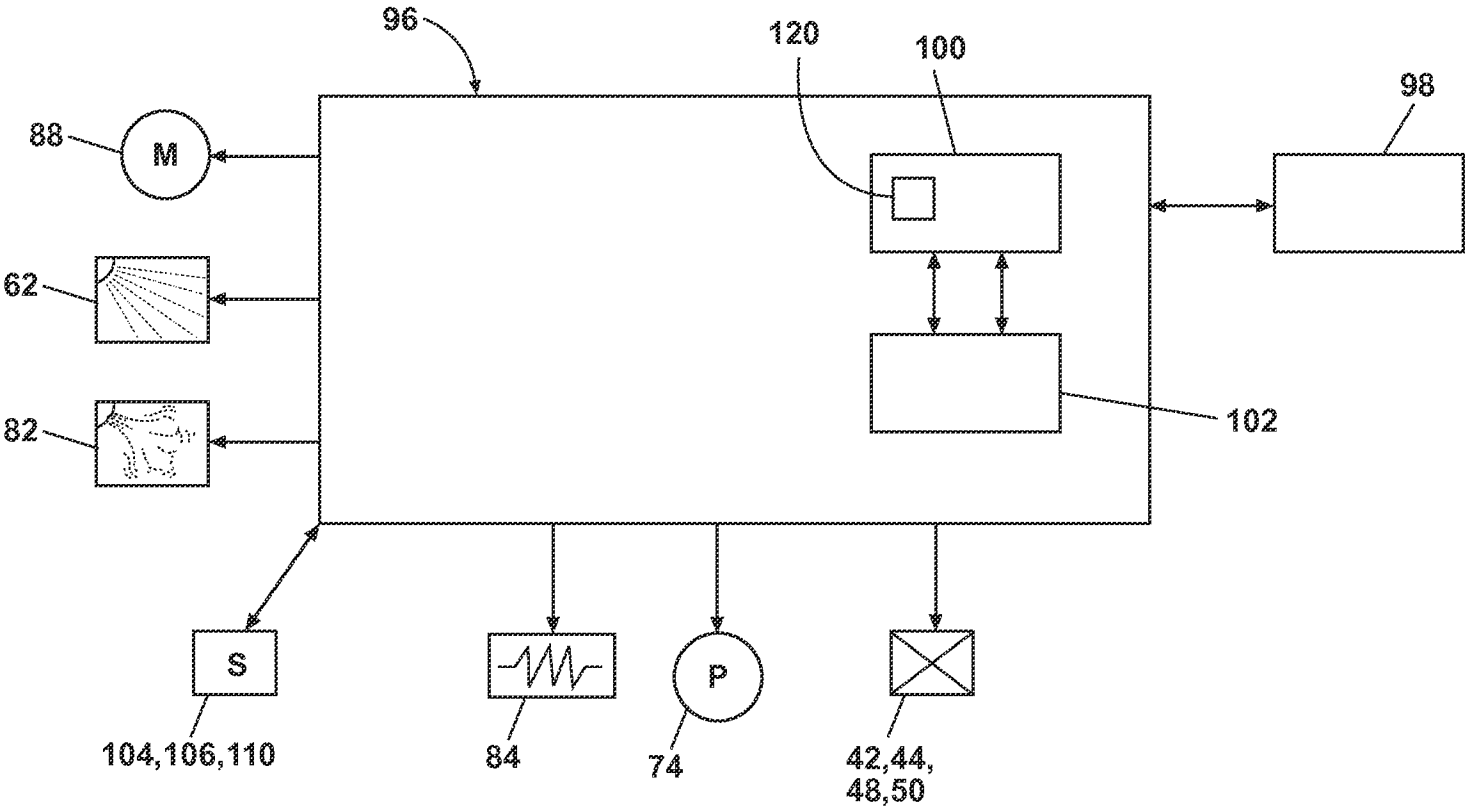
FIG. 2 is a schematic of a control system of the laundry treating appliance of FIG. 1 according to the first embodiment of the invention.

As illustrated in FIG. 2, the controller 96 may be provided with a memory 100 and a central processing unit (CPU) 102.

The memory 100 may be used for storing the control software that is executed by the CPU 102 in completing a cycle of operation using the washing machine 10 and any additional software. Examples, without limitation, of cycles of operation may include: wash, heavy duty wash, delicate wash, quick wash, pre-wash, refresh, rinse only, and timed wash. The memory 100 may also be used to store information, such as a database or table, and to store data received from one or more components of the washing machine 10 that may be communicably coupled with the controller 96. The database or table may be used to store the various operating parameters for the one or more cycles of operation, including factory default values for the operating parameters and any adjustments to them by the control system or by user input. For example, a table 120 may include a table of a plurality of satellizing speed ranges.

The controller 96 may be operably coupled with one or more components of the washing machine 10 for communicating with and controlling the operation of the component to complete a cycle of operation. For example, the controller 96 may be operably coupled with the motor 88, the pump 74, the dispenser 62, the steam generator 82, and the sump heater 84, to control the operation of these and other components to implement one or more of the cycles of operation.

The controller 96 may also be coupled with one or more sensors 104 provided in one or more of the systems of the washing machine 10 to receive input from the sensors, which are known in the art and not shown for simplicity. Non-limiting examples of sensors 104 that may be communicably coupled with the controller 96 include: a treating chamber temperature sensor, a moisture sensor, a weight sensor, a chemical sensor, a position sensor, an imbalance sensor, and a motor torque sensor, which may be used to determine a variety of system and laundry characteristics, such as laundry load inertia or mass.

In one example, one or more load size sensors or load amount sensors 106 may also be included in the washing machine 10 and may be positioned in any suitable location for detecting the amount of laundry, either quantitative (inertia, mass, weight, etc.) or qualitative (small, medium, large, etc.) within the treating chamber 18. The load amount sensors 106 may provide a size output to the controller 96 indicative of an amount of the laundry in the treating chamber 18. By way of non-limiting example, it is contemplated that the amount of laundry in the treating chamber may be determined based on the weight of the laundry and/or the volume of laundry in the treating chamber. Thus, the one or more load amount sensors 106 may output a signal indicative of either the weight of the laundry load in the treating chamber 18 or the volume of the laundry load in the treating chamber 18.

The one or more load amount sensors 106 may be any suitable sensor capable of measuring the weight or volume of laundry in the treating chamber 18. Non-limiting examples of load amount sensors 106 for measuring the weight of the laundry may include load volume, pressure, or force transducers that may include, for example, load cells and strain gauges. It has been contemplated that the one or more such load amount sensors 106 may be operably coupled to the suspension system 28 to sense the weight borne by the suspension system 28. The weight borne by the suspension system 28 correlates to the weight of the laundry loaded into the treating chamber 18 such that the load amount sensor 106 may indicate the weight of the laundry loaded in the treating chamber 18. In the case of a suitable load amount sensor 106 for determining volume it is contemplated that an IR or optical based sensor may be used to determine the volume of laundry located in the treating chamber 18.

Alternatively, the washing machine 10 may have one or more pairs of feet 108 (FIG. 1) supporting the cabinet 12, and a weight sensor (not shown) may be operably coupled to at least one of the feet 108 to sense the weight borne by that foot 108, which may correlate to the weight of the laundry in the treating chamber 18. In another example, the quantity of laundry within the treating chamber 18 may be determined based on output from a motor torque sensor, and the like. Motor torque is a function of the inertia of the rotating drum and laundry. There are known methods for determining the load inertia, and thus the load mass, based on motor torque. It may be understood that the details of the load sensors are not germane to the embodiments of the invention, and that any suitable method and sensors may be used to determine the quantity of laundry.

As another example, a speed sensor 110 may also be included in the washing machine 10 and may be positioned in any suitable location for detecting and indicating a speed output indicative of a rotational speed of the drum 16. Such a speed sensor 110 may be any suitable speed sensor capable of providing an output indicative of the speed of the drum 16. The rotational speed of the drum 16 may also be determined based on motor speed; thus, a speed sensor 110 may include a motor speed sensor for determining a speed output indicative of the rotational speed of the motor 88. The motor speed sensor may be a separate component, or may be integrated directly into the motor 88. Regardless of the type of speed sensor employed, or the manner of coupling the drum 16 with the motor 88, the speed sensor 110 may be adapted to enable the controller 96 to determine the rotational speed of the drum 16 from the rotational speed of the motor 88.

Conventionally, rotation of the drum may be characterized in terms of either rotational speed or frequency. As an example, 1 rotation per second (speed) may be equivalent to 1 Hz or 1 cycle per second (frequency). Thus, speed and frequency may be interchangeable.

Depending upon the rotational speed of the drum 16, the laundry load may undergo at least one of tumbling, rolling (also called balling), sliding, satellizing (also called plastering), and combinations thereof. Tumbling, rolling, sliding, and satellizing are terms of art that may be used to describe the motion of some or all of the items forming the laundry load. For example, during tumbling, fabric items may be carried from a lowest location in the drum 16 towards a highest location in the drum 16, but may fall back to the lowest location before reaching the highest location. During satellizing, the drum 16 may rotate at a speed such that fabric items are held against the inner surface of the drum 16 and rotate with the drum 16 without falling.

Figure 3:
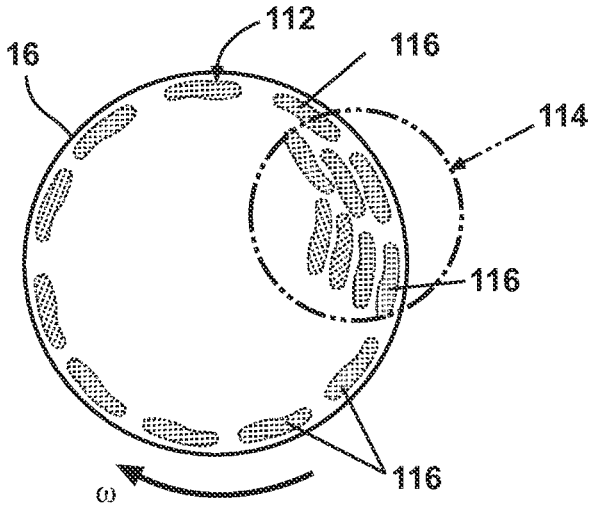
FIG. 3 illustrates a laundry load, including an imbalance, in a drum of the laundry treating appliance of FIG. 1, during a spin phase of a cycle of operation.

During a cycle of operation, a laundry load may become unevenly distributed about the treating chamber 18. Referring to FIG. 3, an unequally distributed laundry load 112 is shown in the drum 16 that is rotated at a spin speed, w, sufficient to satellize the laundry load 112. However, not all satellized laundry items 116 may be located an equal distance from the axis of drum rotation, which may lead to an imbalance 114 due to the uneven distribution of the laundry items 116. During rotation of the drum 16, the imbalance 114 may be characterized as a sinusoidal motor torque signal having a frequency equivalent to the drum rotational speed, w.

Figure 4:
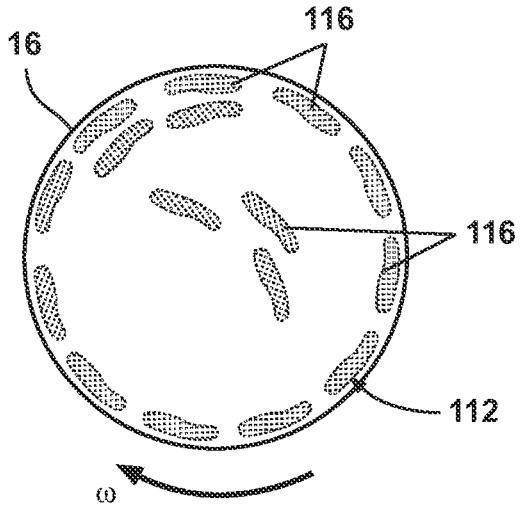
FIG. 4 illustrates the laundry load in the drum of the laundry treating appliance of FIG. 1, a portion of which is tumbling during the cycle of operation.

FIG. 4 illustrates the laundry load 112 during rotation of the drum 16 at a speed, w, which is lower than the speed at which the entire load 112 may be satellized. At this lower rotational speed, some laundry item 116, such as items contributing to the imbalance 114, may tumble. The tumbling items 116 may affect the motor torque signal, which may be characterized as a high-frequency component superimposed on the lower frequency sinusoidal signal.

Figure 5:
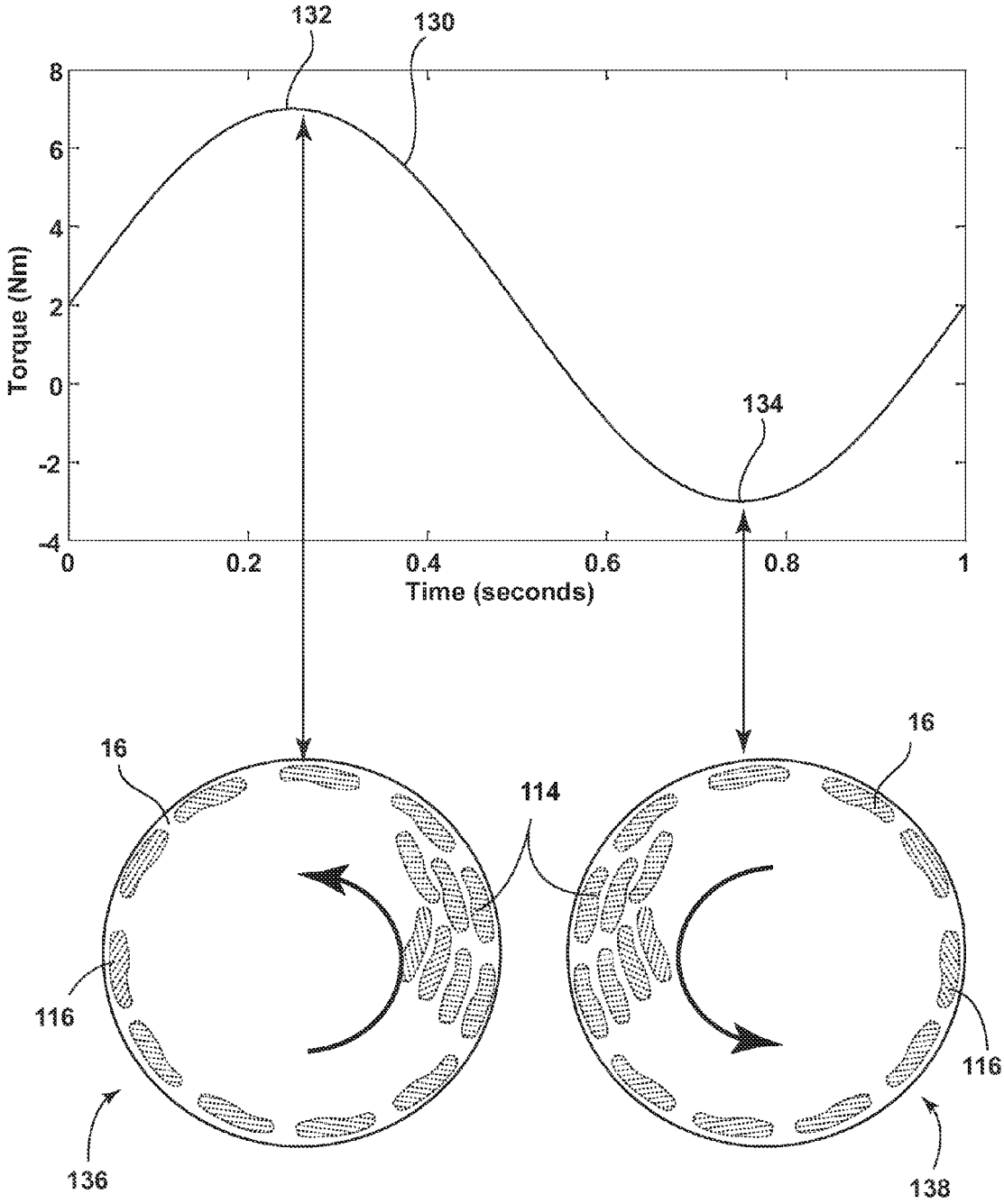
FIG. 5 illustrates the relationship between drum rotation with an imbalance and a motor torque signal.

The controller 96 may be programmed to maintain a selected drum speed, w, by controlling the electric power to the motor 88. As illustrated schematically in FIG. 5, when an imbalance 114 exists within the drum 16, cyclical variations in the motor torque signal 130 may reflect cyclical variations in required motor torque and power. Specifically, when the imbalance 114 may move in an upward direction 136 with rotation of the drum 16, a relatively high level of torque 132 may be developed by the motor 88 to maintain a selected rotational speed, w. Conversely, when the imbalance 114 may move in a downward direction 138 with rotation of the drum 16, a relatively low level of torque 134 may be developed by the motor 88 to maintain the selected rotational speed. The resulting motor torque signal 130 may be sinusoidal.

Figure 6A:
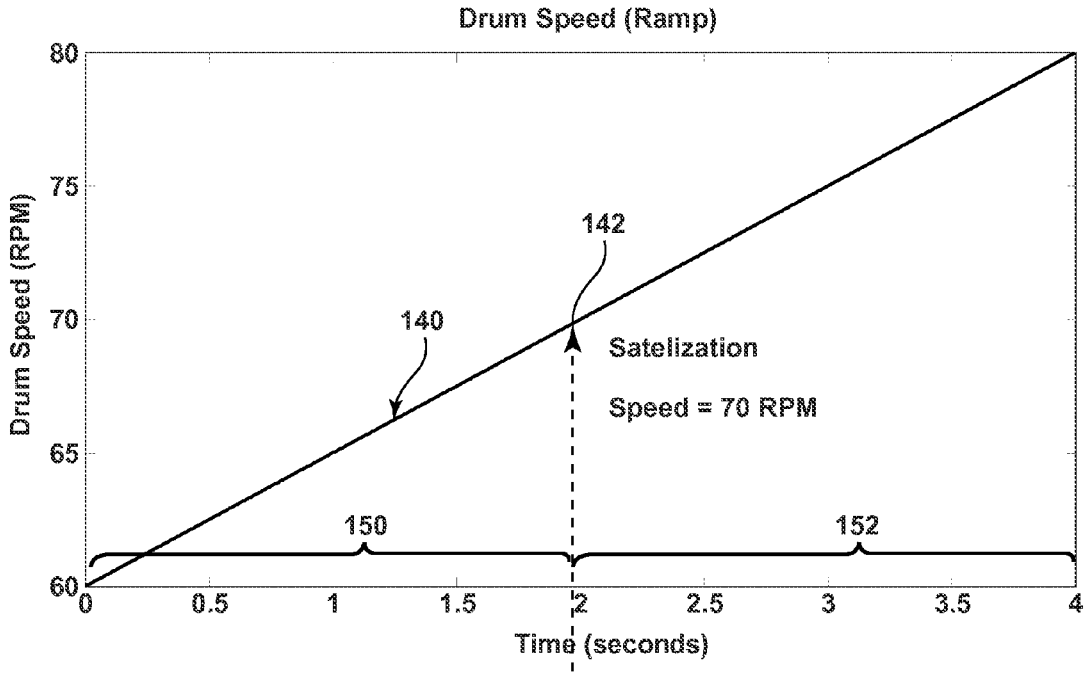
FIGS. 6A & 6B illustrate the relationship between motor torque signal characteristics and satellization of the laundry load.
Figure 6B:
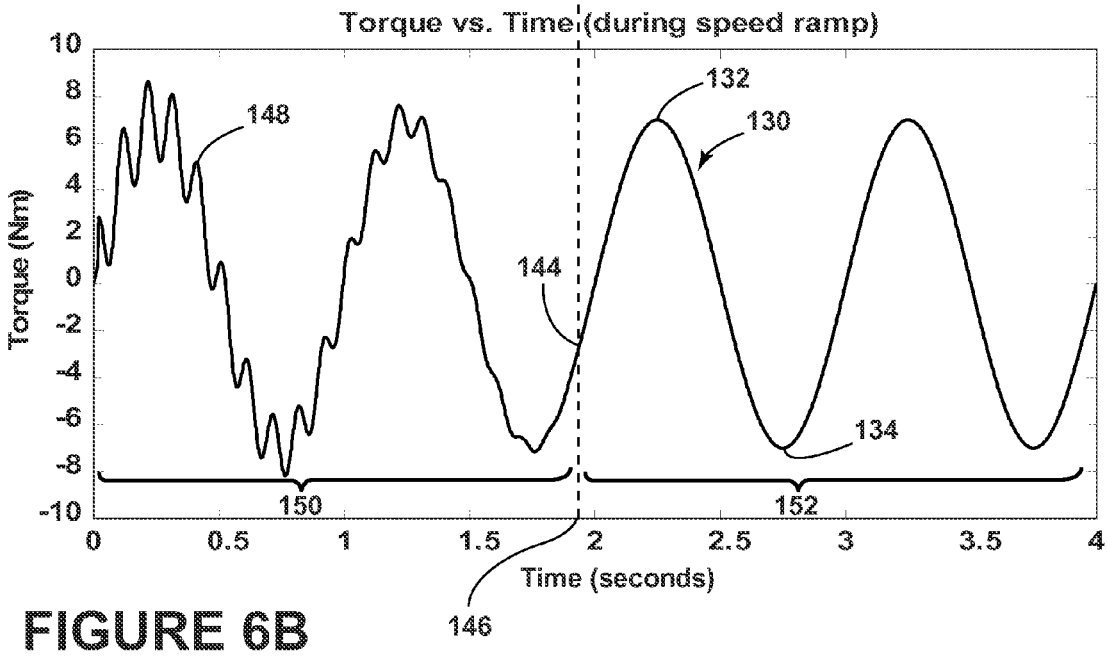

Nevertheless, the motor torque signal 130 may not be purely sinusoidal, especially when only part of the load is satellized. FIGS. 6A and 6B illustrate the correlation with time of drum speed and motor torque. FIG. 6A illustrates a constant increase in drum speed 140 from a drum speed of 60 RPM to a drum speed of 80 RPM for a drum size where satellization occurs around 70 RPM. As it is known that the drum size alters the satellization speed, the description of this specific example is for illustration purposes only and is not meant to be limiting. Assuming that the satellizing speed 142 for the entire load 112 is 70 RPM, some tumbling of laundry items 116 may occur at speeds 150 below 70 RPM. Conversely, no tumbling of laundry items 116 may occur at speeds 152 above 70 RPM.

At speeds near 60 RPM, for example, substantial tumbling of laundry items 116 may occur. This may be illustrated in FIG. 6B as a sinusoidal motor torque signal 130 carrying a high-frequency component 148. As the rotational speed 140 increases, and tumbling decreases, the high-frequency component 148 of the motor torque signal 130 may gradually diminish. When the high-frequency component 148 disappears 144, which may be seen to occur at 1.9 seconds, it may be concluded that satellization 142 has occurred.

Referring again to FIG. 6B, it may be difficult to determine the satellization speed based upon the motor torque signal 130. Determining the time at which the high-frequency component 148 has disappeared may be difficult, which may lead to unsatisfactory inaccuracies in the value of satellization speed. Signal filtering utilizing a high-pass filter may resolve this problem.

A high-pass filter (HPF) is an electronic filter that allows high-frequency signals, or high-frequency components of a signal, to pass through the filter, but blocks signals at frequencies below a selected cutoff frequency. HPFs may be used in conjunction with a low-pass filter to create a band-pass filter. A band-pass filter passes frequencies within a selected range, and blocks frequencies outside that range. A band-stop filter may also be used for this technique if it is desired to allow a selected DC component of the signal to pass through. Allowing a DC component to pass through the filter via a band-pass may enable information about load size (in addition to satellization speed) to be determined from the filtered signal.

Infinite impulse response (IIR) is a property of signal processing systems. Filter systems with infinite impulse response are known as IIR filters. IIR systems have an impulse response function that is non-zero over an infinite length of time.

Figure 7A:
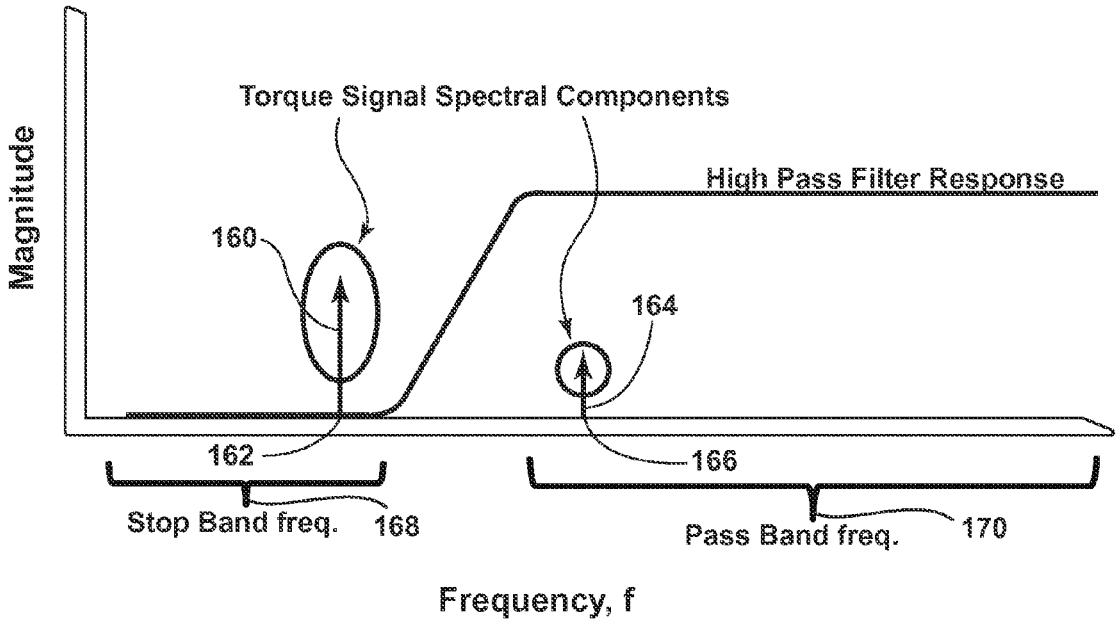
FIGS. 7A & 7B illustrate the effect of a high pass filter on a signal having a drum frequency component and a high-frequency tumbling component.
Figure 7B:
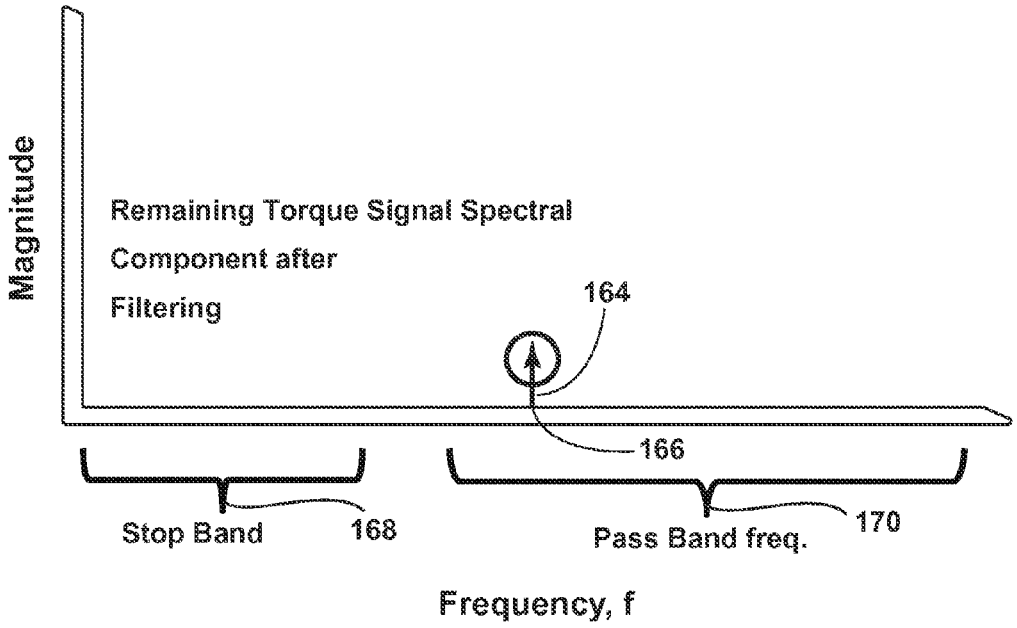

FIGS. 7A and 7B illustrate schematically the basic operation of an IIR signal filter. The filter is configured to condition a signal having different frequencies by blocking portions of the signal having selected unwanted frequencies and passing portions of the signal having frequencies of interest. The y-axis may represent output-to-input magnitude scaling (dimensionless ratio or dB) as a function of frequency. The torque signal spectral components 160, 164, i.e. the vertically-directed arrows, may represent the magnitude of the sinusoidal components of the motor torque signal. The magnitudes of the torque signal spectral components may be interpreted as having units of torque. However, it may be understood that the torque actually varies with time, and magnitude may quantify the range of such variation, e.g., peak-to-peak value=2×magnitude).

FIG. 7A illustrates a high pass IIR filter, which may block a band of frequencies 168 that may be termed "stop band frequencies," and pass a band of frequencies 170 that may be termed "pass band frequencies." The stop band frequencies 168 may encompass the first frequency 162, and the pass band frequencies 170 may encompass the second frequency 164. In the example of FIG. 7A, the stop band frequencies 168 are lower than the pass band frequencies 170. Generally, the stop band is established based upon an anticipated drum frequency, and the pass band is established based upon frequencies at least 20% higher than the drum frequency As illustrated in FIG. 7B, with such a filter the sinusoidal component 160 of the motor torque signal having the lower frequency 162 may be blocked, and the tumbling component 164 of the motor torque signal having the higher frequency 166 may be passed. Thus, the high-frequency component 164 of the motor torque signal may be the only observable component of the motor torque signal, thereby facilitating evaluation of the high-frequency component 164.

A filter may block and pass single frequencies rather than bands of frequencies, or pass lower frequencies and block higher frequencies, and may include combinations of these blocking and passing properties. With the herein described filter, high-pass signal filtering may reduce the motor torque signal to only its high-frequency component. With only the high-frequency component available, the rotational speed at which satellization occurs may be more readily identified.

Figure 8:
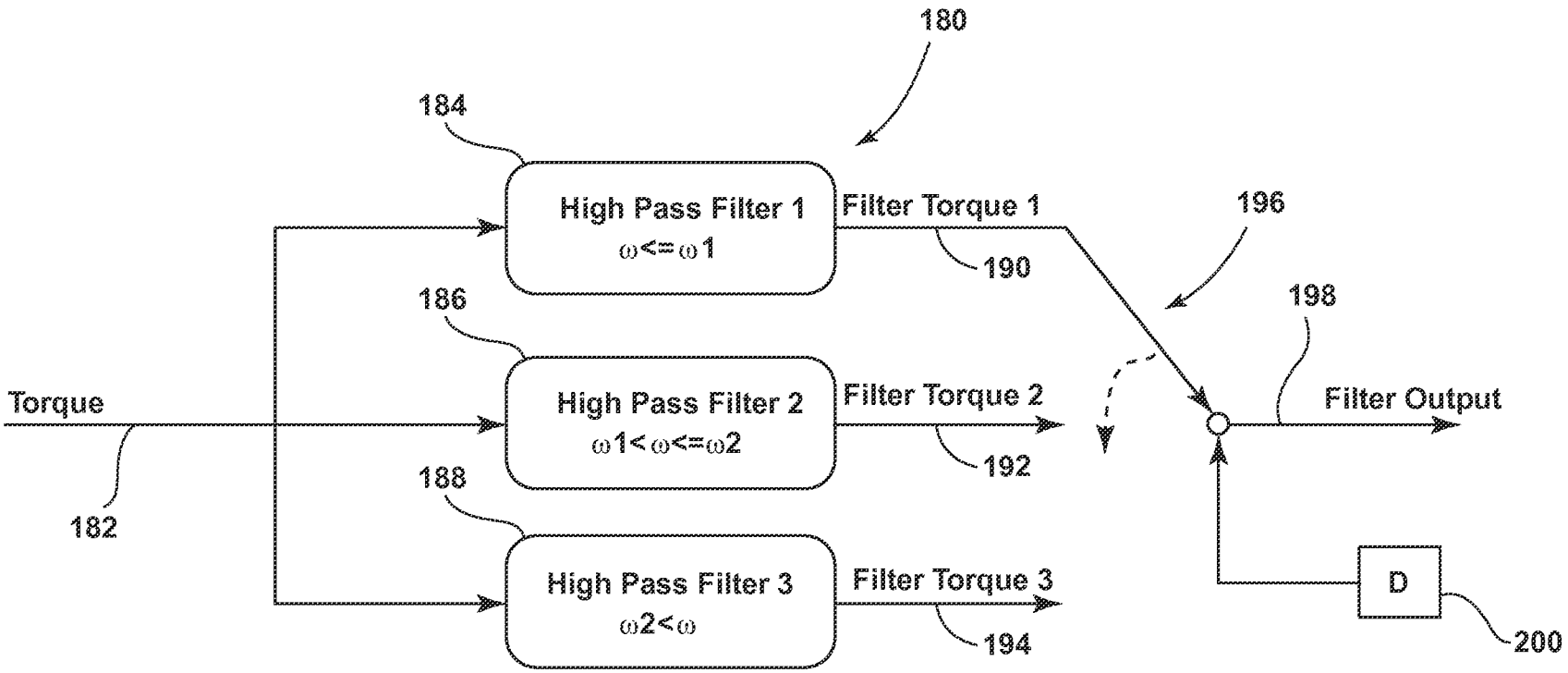
FIG. 8 is a schematic representation of an array of high pass filters having stop bands and pass bands that are selected based upon drum speed.

FIG. 8 schematically illustrates an exemplary array 180 of three high pass filters arranged in parallel that may selectively filter a motor torque signal based upon drum speed. As illustrated in FIG. 8, a motor torque signal 182 may be distributed from a motor torque sensor (not shown) to the filters 184, 186, 188, each of which may include a stop band associated with a selected drum frequency and a pass band associated with a selected tumbling frequency. Each of the three stop bands may be associated with a selected drum frequency, and each of the three pass bands may be associated with a selected tumbling frequency. For example, the filter 184 may be configured to filter motor torque signals associated with a drum rotation speed less than or equal to a first rotation speed, $\omega_1$. The filter 186 may be configured to filter motor torque signals associated with a drum rotation speed greater than the first rotation speed, $\omega_1$, and less than or equal to a second rotation speed, $\omega_2$.

The filter 188 may be configured to filter motor torque signals associated with a drum rotation speed greater than the second rotation speed, $\omega_2$. As the drum frequency increases, the stop band frequencies must be increased, otherwise the filter may allow high drum frequencies to pass if the pass band is relatively low. Thus, each filter 184, 186, 188 may block a different filtered signal 190, 192, 194, respectively. A switch 196 may be configured for selectively alternate coupling with one of the filters 184, 186, 188 and selection of a filtered signal 190, 192, 194 as a filter output signal 198. The switch 196 may be coupled with a drum speed sensor 200 for automated selection of a filter 184, 186, 188 based upon drum rotational speed.

Figure 9A:
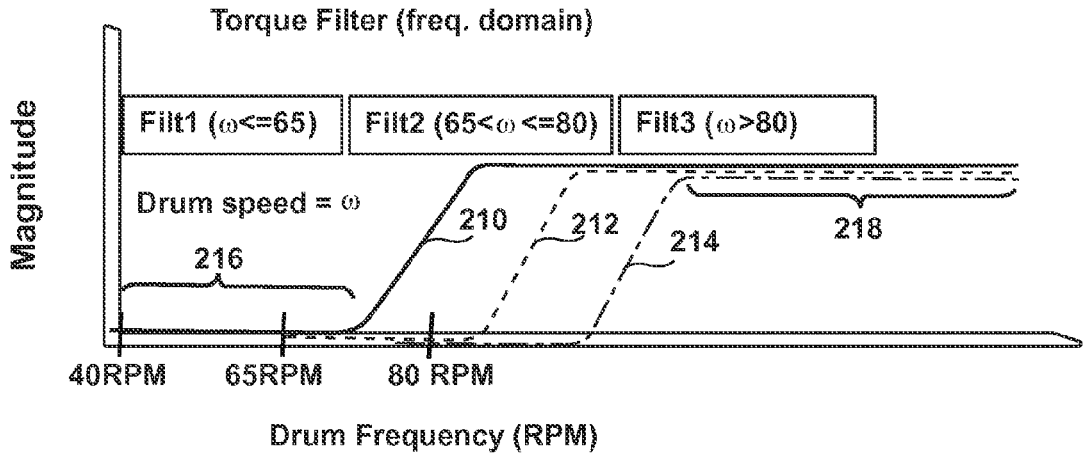
FIGS. 9A & 9B illustrate the filtering characteristics of the array of filters illustrated in FIG. 8.

FIG. 9 illustrates an exemplary correlation between drum speed and motor torque, and the filtering effect possible with a parallel array of different filters. For example, as illustrated in FIG. 9A, a first filter 210 may have a stop band configured to block motor torque signal frequencies at drum speeds lower than about 70 to 75 RPM, and pass motor torque signal frequencies at drum speeds greater than about 85 RPM. A second filter 212 may have a stop band configured to block motor torque signal frequencies at drum speeds between about 65 and 85 RPM, and pass motor torque signal frequencies at drum speeds greater than about 95 RPM. A third filter 214 may have a stop band configured to block motor torque signal frequencies at drum speeds between about 75 and 95 RPM, and pass motor torque signal frequencies at drum speeds greater than about 105 RPM.

Figure 9B:
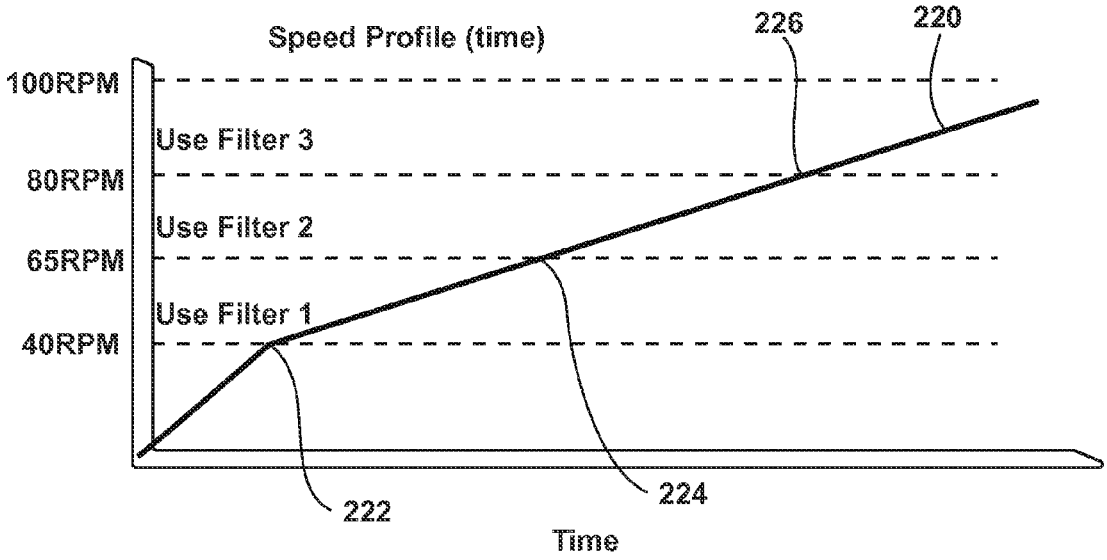

For example, referring to the speed profile 220 illustrated in FIG. 9B, at drum speeds below 40 RPM signal filtering may not be utilized. When the drum speed 222 reaches 40 RPM, the first filter 210 may be active. When the drum speed 224 reaches 65 RPM, the second filter 212 may be active. When the drum speed 226 reaches 80 RPM, the third filter 214 may be active.

The net effect of this configuration of filters is that low frequency motor torque signals will be blocked 216 up to a drum speed of about 95 RPM, and that high-frequency motor torque signals will be passed 218 at a drum speed of about 85 RPM and greater. Thus, regardless of drum speed, the drum frequency component may be removed from the filter output signal 198, and only the high-frequency component related to tumbling will be present.

It may be understood that, although three filters are illustrated, a greater or lesser number of filters may be utilized based upon factors such as anticipated frequency characteristics, configuration of the washing machine 10, characteristics of a laundry load, and the like.

Figure 10A:
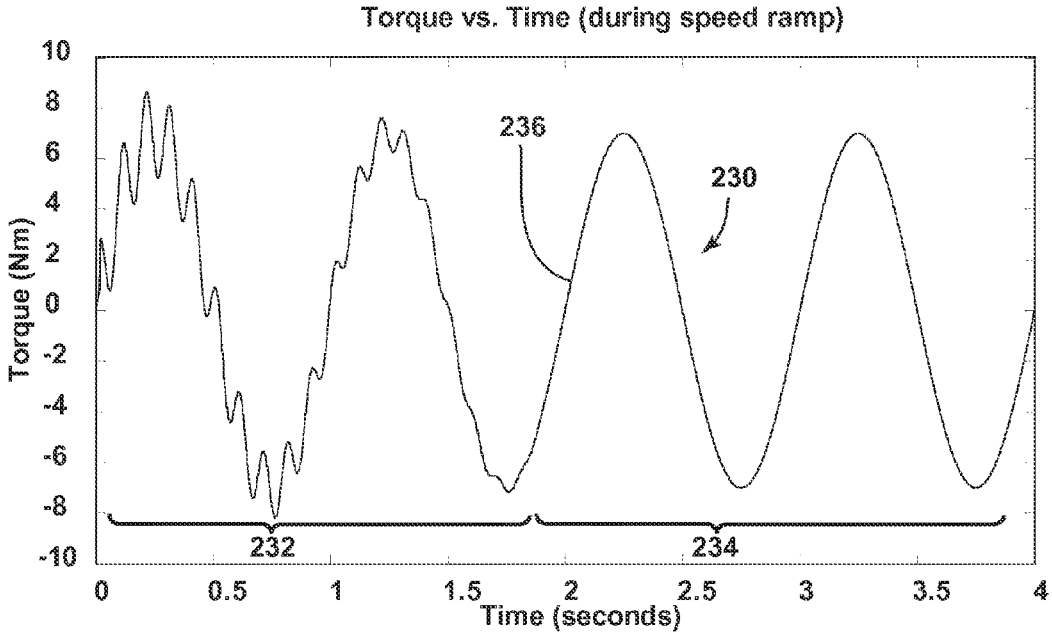
FIGS. 10A-D illustrate a method of conditioning a motor torque signal having a drum frequency component and a superimposed high-frequency component to block the drum frequency, pass and enhance high frequencies, and facilitate identification of the satellization speed.

FIGS. 10A-D illustrate schematically the exemplary conversion of a motor torque signal to a windowed average power curve during the ramp-up of drum speed through the satellization frequency. FIG. 10A illustrates the transition of a motor torque signal 230 having a generally sinusoidal trace 236 and a superimposed high-frequency component due to tumbling. The motor torque signal 230 may have a first portion 232 with a high-frequency component and a second portion 234 without the high-frequency component.

Figure 10B:
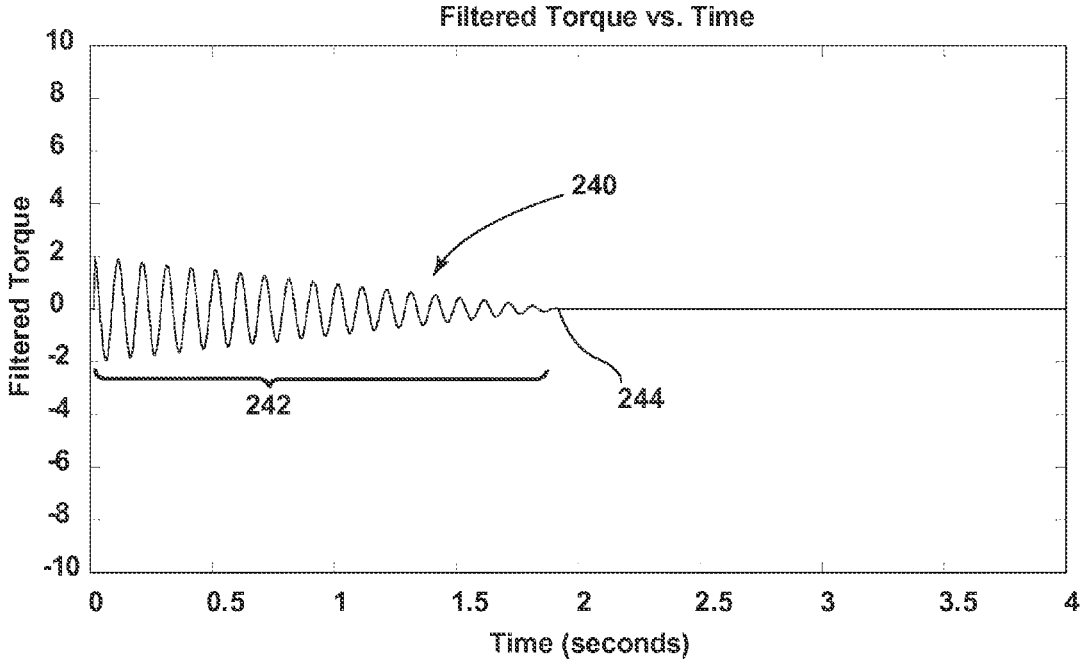
Figure 10C:
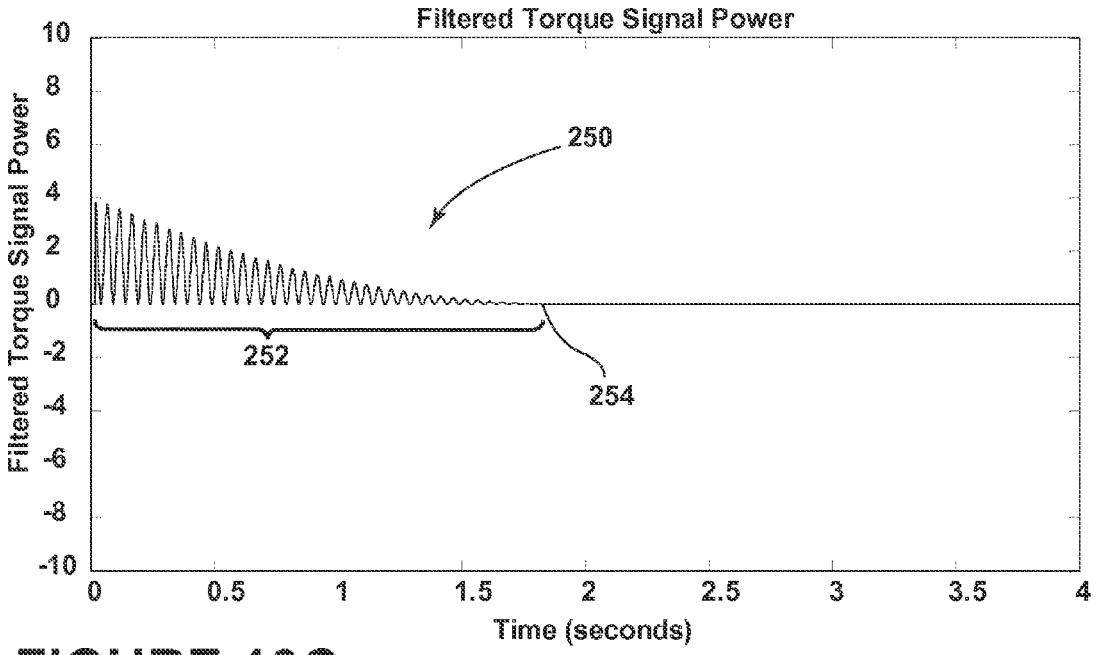

FIG. 10B illustrates an exemplary filter output signal 240 representing the decrease in the frequency 242 of the component of the torque signal related to clothes tumbling as the satellization speed 244 is reached. Because the filtered motor torque signal 240 may have a relatively small amplitude compared, for example, to noise or other stray frequencies, the signal 240 may be conditioned to facilitate the identification of points of interest along the signal 240. FIG. 10C illustrates an exemplary instantaneous signal power curve 250 which may be obtained by a squaring function applied to the filtered signal 240. The result may be a positive signal power curve 250 having a decreasing amplitude 252 due to the component of the torque signal related to clothes tumbling decreasing in frequency as the satellization speed 254 is approached. This may enable the satellization speed to be more precisely defined.

Figure 10D:
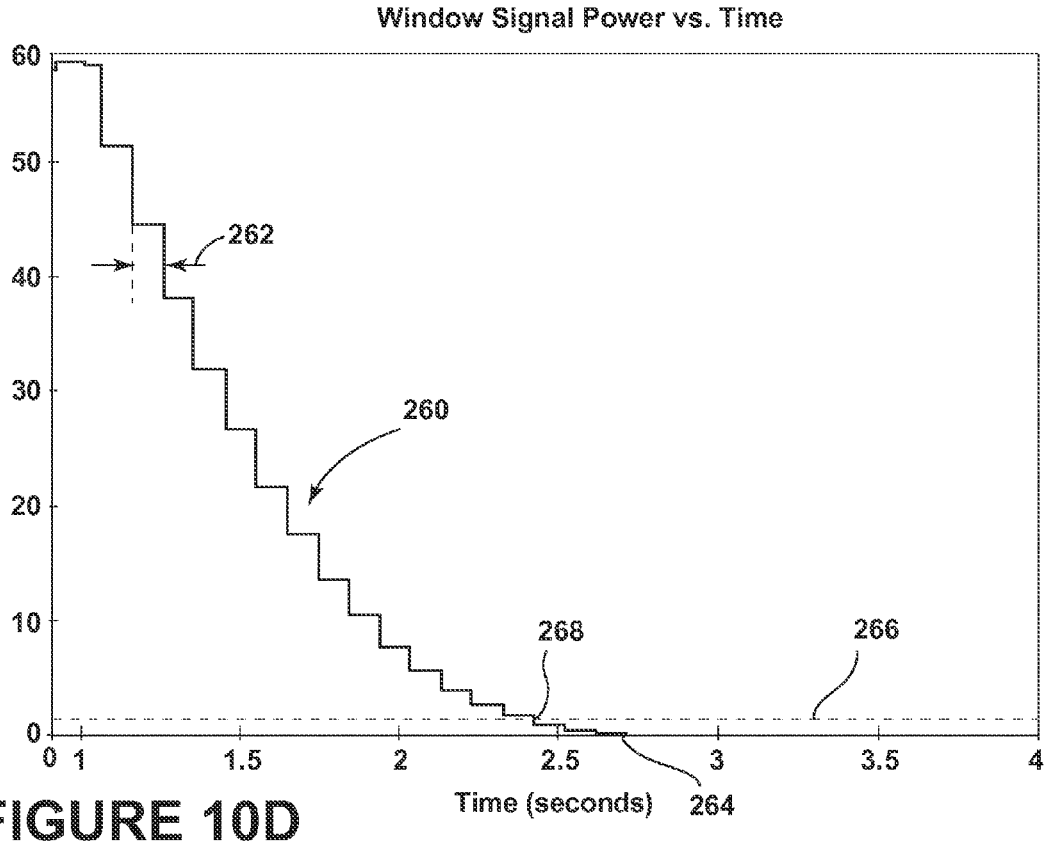
Figure 11:
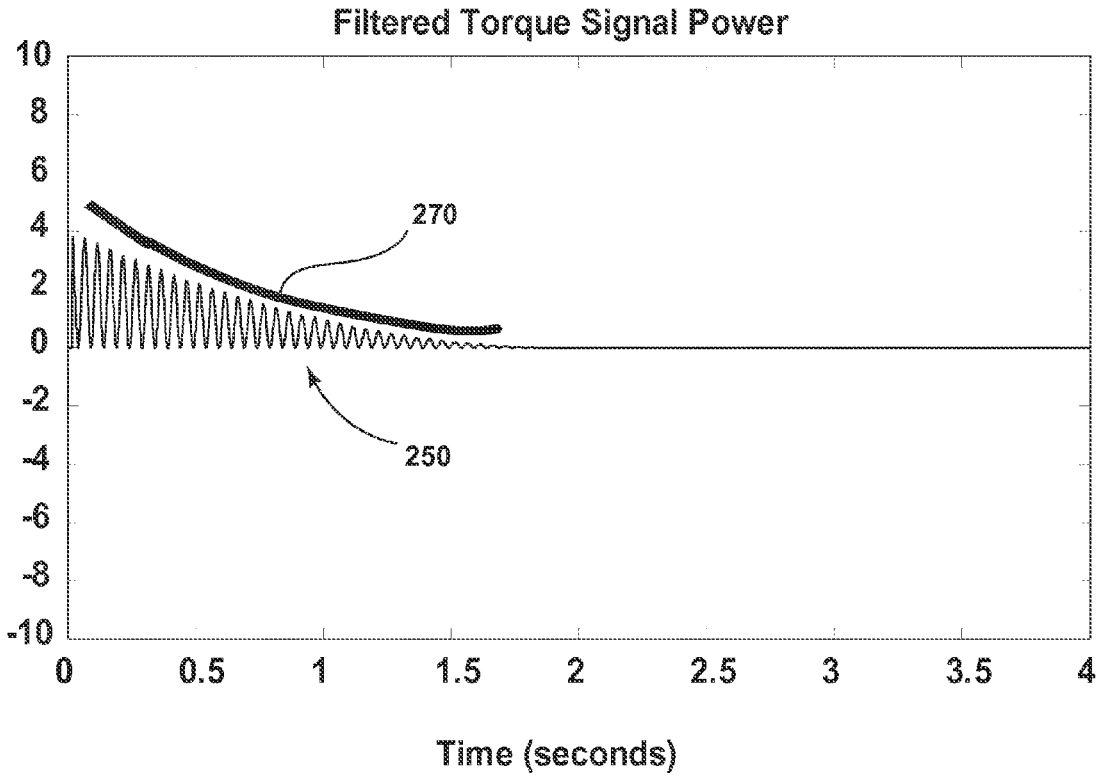
FIG. 11 illustrates an intermediate step in the method illustrated in FIGS. 10A-D.

The relationship between Windowed Average Power and time is illustrated in FIG. 10D. The Windowed Average Power may be utilized to identify satellization speed using a threshold. Without using Windowed Average Power, the satellization speed may be identified, but in a computationally less optimal manner. FIG. 11 illustrates a signal power envelope 270 defined by the power curve 250 which may be utilized in determining values of Windowed Average Power. As an example, the following method may be utilized.

For purposes of the example, it may be assumed that data is collected at a 10 millisecond rate, i.e. 100 data values per second, and that the signal power envelope 270 may be divided into a selected number of equal segments. Thus, each segment may be 0.1 second in length, and for each 0.1 second, there may be 10 data points, i.e. 100 data points per second, 0.1 second duration. For purposes of the example, a 1 second window may be assumed.

The power data points may be summed for each 0.1 second segment, and a series of summations, equal to the total number of segments, may be accumulated. An array equal to a selected number of sequential segments may be defined, e.g. 10 segments. If the oldest 0.1 second summation is dropped, and the newest summation that may maintain 10 segments is added, an updated array may be computed every 0.1 second. In other words, every 0.1 second the oldest data is dropped and the newest data is added. A Windowed Average Power that contains 1 second of data, but is updated every 0.1 second, may be the result. By updating every 0.1 second, the determination of satellization speed may be achieved approximately 10 times quicker than if the array were updated every 1 second. Because of the properties of the update rate in relation to the window duration, the Windowed Average can be referred to as a Sliding Windowed Average. Alternatively, the window may be a length other than 1 second, and may be selected based upon the total length of the signal power envelope 270, or the number of segments may be other than 10.

For example, the window may be defined by three sequential segments. Assuming that v=value, v1=average signal power for first segment, v2=average signal power for second segment, v3=average signal power for third segment, and so on. The first window may consist of segments 1-3. The average signal power for the first window may be determined as the average of v1, v2, and v3.

The second window may consist of segments 2-4, and the average signal power for the second window may be determined as the average of v2, v3, and v4. This may be continued until an average signal power for all windows has been determined.

As may be seen from FIG. 10D, the exemplary power curve 250 may be converted into a stepped Windowed Average Power curve 260 having segments 262 of 0.1 second. As FIG. 10D also illustrates, satellization may be determined to have occurred when the average signal power for a window 264 reaches zero.

Rather than continuing the process until a Windowed Average Power=0 is obtained, it may be sufficient to consider satellization to have occurred at a Windowed Average Power of somewhat greater than zero, i.e. the value represented by the threshold 266. Where the Windowed Average Power curve intersects 268 the threshold 266, satellization may be taken to have occurred. Thus, converting the power curve 250 of FIG. 10C to Windowed Average Power over time may further facilitate identification of the point of satellization.

Motor torque signal filtering to determine satellization speed may have the advantage of reducing the number of measurements and calculations utilized in an inertia-based method. Utilizing filters and evaluating filtered motor torque signals may provide results efficiently and with improved accuracy.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

What is claimed is:

1. A method of determining when a laundry load has satellized within a rotating drum of a laundry treating appliance having a motor for rotating the drum and a controller for controlling the rotation of the drum, the method comprising:

accelerating the rotational speed of the drum from a non-satellizing speed to a satellizing speed by supplying a control signal from the controller to the motor;

monitoring a high frequency component of a torque signal of the motor by applying, during the accelerating, one of a high pass filter, a band pass filter, and a band stop filter to the torque signal, to permit the passing of frequencies greater than the drum frequency to generate a filtered torque signal, with the high frequency component having a frequency greater than a rotational frequency of the drum;

determining that the load is satellized when the amplitude of the high frequency component lies below a predetermined threshold relative to zero.

2. The method of claim 1, wherein the supplying a control signal comprises supplying a constant acceleration control signal.

3. The method of claim 1 wherein the high pass filter permits the passing of frequencies greater than 1.2 times the drum frequency.

4. The method of claim 1 wherein the applying a high pass filter to the torque signal comprises applying an array of high pass filters having sequentially increasing cutoff frequencies.

5. The method of claim 4 wherein each of the high pass filters comprises a stop band and a pass band, with the stop bands selected such that adjacent high pass filters have, lines, overlapping portions of the stop bands, and a transition from one of the high pass filters to the next high pass filter occurs when the drum frequency lies within the overlapping portions.

6. The method of claim 5 wherein each pass band has a frequency greater than the drum frequency.

7. The method of claim 6 wherein frequencies that are greater than or equal to 1.2 times the drum frequency are contained within the pass band of the high pass filter.

8. The method of claim 5 wherein the determining the load is satellized comprises determining when the filtered torque signal lies within a predetermined threshold relative to zero.

9. The method of claim 8 wherein the filtered torque signal is squared to generate a power signal and the determining the load is satellized comprises determining when the power signal lies within a predetermined threshold relative to zero.

10. The method of claim 9 wherein the power signal is averaged over a time window to form a windowed averaged power value and the determining the load is satellized comprises determining when the windowed averaged power value lies within a predetermined threshold relative to zero.

11. The method of claim 1 wherein the determining the load is satellized comprises determining when a filtered torque signal lies within a predetermined threshold relative to zero.

12. The method of claim 11 wherein the filtered torque signal is squared to generate a power signal and the determining the load is satellized comprises determining when the power signal lies within a predetermined threshold relative to zero.

13. The method of claim 12 wherein the power signal is averaged over a time window to form a windowed averaged power value and the determining the load is satellized comprises determining when the windowed averaged power value lies within a predetermined threshold relative to zero.

* * * * *